US008395094B2

(12) United States Patent
Long

(10) Patent No.: US 8,395,094 B2
(45) Date of Patent: Mar. 12, 2013

(54) STRUCTURE FOR CONDUCTING HEAT FROM CARTRIDGE HEATERS

(75) Inventor: Michael Long, Hilton, NY (US)

(73) Assignee: Eastman Kodak Company, Rochester, NY (US)

( * ) Notice: Subject to any disclaimer, the term of this patent is extended or adjusted under 35 U.S.C. 154(b) by 466 days.

(21) Appl. No.: 12/699,120

(22) Filed: Feb. 3, 2010

(65) Prior Publication Data

US 2011/0186557 A1 Aug. 4, 2011

(51) Int. Cl.
*H05B 1/00* (2006.01)

(52) U.S. Cl. ..... 219/544; 219/546

(58) Field of Classification Search ..... 257/544, 257/546; 219/544, 546

See application file for complete search history.

(56) References Cited

U.S. PATENT DOCUMENTS

| | | | | |
|---|---|---|---|---|
| 2,469,801 | A | 12/1945 | Vogel et al. | |
| 2,831,951 | A | 4/1958 | Desloge | |
| 3,335,459 | A | 8/1967 | Tyrner | |
| 3,412,231 | A | 11/1968 | McElligott | |
| 3,937,923 | A | 2/1976 | Smith | |
| 3,982,099 | A | 9/1976 | Churchill | |
| 4,439,915 | A | 4/1984 | Gellert | |
| 4,688,622 | A | 8/1987 | Gellert | |
| 4,832,254 | A | 5/1989 | Peuke et al. | |
| 5,095,193 | A * | 3/1992 | Doyle | 219/536 |
| 6,444,952 | B2 * | 9/2002 | Ballem et al. | 219/205 |
| 7,307,247 | B2 | 12/2007 | Bower et al. | |
| 7,592,572 | B2 * | 9/2009 | Schlipf | 219/532 |
| 7,963,760 | B2 * | 6/2011 | Cho et al. | 425/547 |
| 7,977,610 | B2 * | 7/2011 | Hamburger et al. | 219/537 |
| 2002/0094196 | A1 | 7/2002 | Schwartz | |
| 2006/0233910 | A1 * | 10/2006 | Wheeler et al. | 425/547 |
| 2010/0147826 | A1 * | 6/2010 | Schlipf | 219/481 |
| 2010/0225072 | A1 * | 9/2010 | Fukushima et al. | 277/631 |

FOREIGN PATENT DOCUMENTS

| | | |
|---|---|---|
| CA | 393 671 | 1/1941 |

* cited by examiner

*Primary Examiner* — Eugene Lee
(74) *Attorney, Agent, or Firm* — Nancy R. Simon

(57) ABSTRACT

A heating structure includes an opening that surrounds a heating element and a heat transfer element. Each heat transfer element is disposed between an exterior surface of the heating element and an interior surface of the opening. A clamping mechanism is used to clamp each heating element against a heat transfer element. Each heat transfer element partially surrounds a heating element and is configured to create at least two elongated and spatially separate contact regions along a length of the heating element. The at least two contact regions form a line of contact between the heating element and the interior surface of the opening when the heating element is clamped against the heat transfer element. The at least two contact regions allow the heating element to transfer heat to the opening and to the tooling device. The clamping mechanism may also be used to transfer heat to the tooling device.

11 Claims, 2 Drawing Sheets

STRUCTURE FOR CONDUCTING HEAT FROM CARTRIDGE HEATERS

TECHNICAL FIELD

The present invention relates to electric cartridge heaters, and more particularly to a structure for conducting heat away from electric cartridge heaters.

BACKGROUND

Cartridge heaters are often used to heat tooling machines or other devices. Typically, the cartridge heaters are inserted into bores formed or drilled in the tooling or device. Unless expensive machining operations are used, the tolerance in the bore diameter and the cartridge heater diameter results in very small clearance between the cartridge heater and the bore. By way of example only, the clearance can be as small as 0.1 millimeters (mm).

To be able to insert the cartridge heater into the bore, small air spaces are necessarily left between the outside of the cartridge heaters and the bores in the tooling. The air spaces have an insulating effect and substantially reduce the effectiveness of the heaters. Additionally, the dimensions of the air spaces are not always uniform along each heater. This non-uniformity causes the heat to transfer unevenly along the length of the cartridge heater as well as unevenly away from the electric heating element within the heater. Hot spots are produced along the heating element when heat transfer is uneven, and these hot spots cause the heating element to burn out. The system must then be shut down so the cartridge heater can be replaced, thereby increasing the operating costs of such systems and reducing product throughput.

U.S. Pat. No. 7,307,247 notes that if a cartridge heater has too much clearance between the bore and the outer surface of the cartridge heater, heat transfer rates are reduced, heater sheath temperature is increased, and power demands are increased. An improperly installed cartridge heater will lead to rapid heater failure. In practice, improper installation often cannot be tested or seen until it is too late and the heater has failed.

U.S. Pat. No. 2,831,951 teaches bore fit dimensions based on the cartridge power density and the desired heater block operating temperature. For example, a bore sized 0.2 mm larger than the cartridge heater diameter will provide adequate thermal contact and long heater life for a power density of 130 W/in$^2$ for a heater block temperature of 500° C. operating in air. Although a 0.2 mm clearance is easily attained, actual use data suggests that the failure rate is high with such a clearance. In a vacuum environment, the convection and gas conduction normally available to transfer heat from the cartridge heater to the bore is absent, causing unacceptably high cartridge heater temperatures to be attained even in bores with only 0.02 mm clearance. Localized areas of the sheath glow bright orange, overheat, expand and bond to the bore. This causes service nightmares, as heaters often need to be drilled out before they can be replaced. Drilling out the cartridge often results in scoring or enlarging the bore which greatly increases the likelihood that the replacement heater will fail in an even shorter time period.

Even cartridge heaters operating properly in air create very high temperature gradients in the area of the heater bore. The temperature at the heater surface can be over 200% of the desired system temperature, as disclosed in U.S. Pat. No. 2,831,951. This causes thermal stresses across the cartridge heater to bore interface, but also presents a challenge in controlling the temperature in the system. A time lag exists between a command to increase system temperature and the attainment of the desired temperature due to the high thermal resistance path between the cartridge heater and the heater bore. This time lag leads to temperature overshoot and the inability to maintain a desired temperature within tight control limits.

To overcome the poor thermal connection between the cartridge heater and the load, U.S. Pat. Nos. 4,688,622 and 4,439,915 describe integrally casting or brazing the cartridge heater into bores in the heater block. Similar methods of filling the air voids with a poured-in metal such as copper are described in U.S. Pat. Nos. 4,832,254 and 4,439,915. Copper is often chosen for its high thermal conductivity but with a melting point of 1083° C., the brazing or metal flowing step requires that the entire part be heated in a vacuum furnace and makes it virtually impossible to replace a cartridge heater at the end of its useful lifetime without also replacing the entire heater assembly.

An additional problem with brazing the cartridge heater in place is discussed in U.S. Pat. No. 2,469,801. The common commercial brazing alloys, made of silver, copper, and zinc in varying proportions, penetrate the nickel chromium-iron alloy cartridge heater sheath along the grain boundaries, and cause general inter-granular disintegration with resultant loss of cohesive strength in the sheath alloy. Such sheath defects cause premature electrical failures.

Canadian Patent Application Serial Number 393, 671 describes casting a tubular heating element into channels in the surface of a member to be heated instead of drilling bore holes. Similar advantages arise in providing improved heat transfer from the tubular heaters due to the cast metal bond but it is impossible to replace the cartridge heaters individually.

U.S. Pat. No. 3,335,459 describes flowing a solder into the narrow space between the cartridge heater and the bore such that the solder is in the liquid state at normal heater operating temperatures. The liquid solder provides good thermal contact with the cartridge heater and allows heater removal for replacement at far lower temperatures than other methods. In high vacuum applications, however, the vapor pressure of the liquid solder at the temperature of the cartridge heater may pose a problem as the liquid solder slowly evaporates and deposits on cooler surfaces.

Several methods have been developed to overcome the problems associated with permanently brazing or casting cartridge heaters in place while still establishing good thermal contact between the cartridge heater and the bore. U.S. Pat. No. 3,937,923 proposes inserting the cartridge heaters into sleeves having a custom close fit to the cartridge heater and a close fit to an oversized, standard bore diameter. While this offers improved thermal contact that may be sufficient for operation in a gas filled environment, testing in vacuum revealed that an interference fit is required to effectively transmit heat from the cartridge heater to the bore and obtain acceptable heater life.

U.S. Pat. No. 3,412,231 describes inserting a tapered, split sleeve around the cartridge heater and tapping the assembly into a tapered bore to create radial clamping forces as the result of axial motion between the tapered sleeve and tapered bore. This method achieves an interference fit with the cartridge heater and an improved thermal contact that should be effective even in a vacuum environment, but the manufacture of the tapered bores is significantly more difficult and expensive, particularly for long cartridge heaters and requires much larger bores than would be required for the cartridge heaters themselves. The increased mass and surface area of the heated tooling to allow for the increased heater bores increases the power necessary to heat the tooling and decreases its thermal response time. The increased bore size also increases the spacing between adjacent cartridge heaters and thereby reduces the maximum watt density attainable in the heated tooling.

U.S. Pat. No. 3,982,099 describes a split sheath cartridge heater configuration intended to expand into an oversized bore. The sheath is made of an Inconnel alloy and because the interior, flat faces of the sheath cannot dissipate heat to the bore they will be hotter than the exterior, semi-circular surfaces. The temperature difference between the interior and exterior surfaces causes differential thermal expansion resulting in the open end of the split heater contacting the bore as well as a percentage of the rest of the heater. The folded-over end of the split heater does not expand to any appreciable extent and is subject to overheating, especially for cartridge heaters less than 10 cm in length. This design reduces the air gap relative to standard cartridge heaters and may be advantageous in a gas filled environment, but testing in vacuum shows that the contact area or contact force afforded by the differential expansion is not adequate to prevent a large percentage of very premature heater failures.

United States Patent Application Publication 2002/0094196 describes a heated block having features to permit the block to deform to clamp the cartridge heater, providing good heat transfer, generally along two lines of contact. In one embodiment, the heated block includes a full cut extending from a surface of the block to the cavity and a partial cut extending from a surface of the block towards the cavity to facilitate deformation by creating a flexural hinge in the vicinity of the partial cut. The full and partial cuts are parallel to one another, extend the length of the block, and are on adjacent surfaces of the block. As the clamping bolt is tightened, the portion of the heated block between the full and partial cuts will rotate a small amount about the flexural hinge causing the edge adjacent the full cut to move toward the cartridge heater. This creates a compressive load between the cartridge heater and the heated block. In theory, a clamping structure based on an originally circular bore that is infinitesimally larger than the cartridge heater diameter provides two lines of contact between the cartridge heater and the heater block that are diametrically opposite each other. Elastic deformation, present particularly at elevated temperature, widens the theoretical contact lines into narrow contact rectangles but even minor machining marks on the surface of either the cartridge heater or the heater block bore will reduce the contact area. More than two lines of contact can be achieved if the bore in the heated block is machined to have a non-circular cross section by, for example, wire electric discharge machining but the machining cost is higher than for circular bores formed by drilling. The clamping structure provides removable and secure contact between the cartridge heater and the heater block but heat transferred through the upper line of contact has a relatively long and inefficient thermal path through the bolt and through the flexural hinge to contribute heat to the heating block. The provisions for clamping screws and the additional heated area that accompanies the clamping hardware increases the heated area, and the required power while decreasing the thermal response time of the heated member, both heating and cooling. The space occupied by the clamping hardware additionally increases the spacing between adjacent cartridge heaters and thereby reduces the practical watt density available to rapidly heat the heating block.

A second embodiment disclosed in United States Patent Application Publication 2002/0094196 configures the block with a multi-piece construction to provide for clamping the cartridge heater. The block includes an upper part and a lower part that define a cylindrical cavity there between. The upper and lower parts are clamped together by two or more bolts to hold the heater in position. Again, there are two theoretical lines of contact between the heater cartridge and a cylindrical bore in the heater block assembly to provide good thermal transfer but this configuration is particularly inefficient since heat transferred to the upper clamping block can only contribute heat to the lower heating block after passing through the clamping bolts.

The prior art heating structures transfer heat from a cartridge heater to a heated block but suffer from the inconveniences of either rendering the cartridge heater non-removable or increasing the size of the tooling and the power required in accommodating clamping structures.

SUMMARY

A tooling device includes at least one heating structure. Each heating structure includes an opening that surrounds a heating element and a heat transfer element. Each heat transfer element is disposed between the exterior surface of the heating element and the interior surface of the opening. A clamping mechanism is used to clamp each heating element against a heat transfer element. Each heat transfer element partially surrounds a heating element and is configured to create at least two elongated and spatially separate contact regions along a length of the heating element. The at least two contact regions form a line of contact between the heating element and the opening when the heating element is clamped against the heat transfer element. The at least two contact regions allow the heating element to transfer heat to the interior surface of the opening and to the tooling device. The clamping mechanism may also be used to transfer heat to the tooling device.

BRIEF DESCRIPTION OF THE DRAWINGS

Embodiments of the invention are better understood with reference to the following drawings. The elements of the drawings are not necessarily to scale relative to each other.

DETAILED DESCRIPTION

Figure 1:
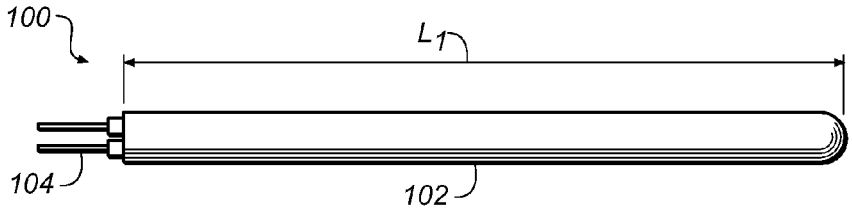
FIG. 1 depicts a heating element in an embodiment in accordance with the invention.

Throughout the specification and claims, the following terms take the meanings explicitly associated herein, unless the context clearly dictates otherwise. The meaning of "a," "an," and "the" includes plural reference, the meaning of "in" includes "in" and "on." The term "connected" means either a direct electrical or physical connection between the items connected, or an indirect connection through one or more passive or active intermediary devices.

Referring to the drawings, like numbers indicate like parts throughout the views.

FIG. 1 depicts a heating element in an embodiment in accordance with the invention. Heating element 100 includes heating section 102 and leads 104. Heating section 102 has a length $L_1$ and generates heat when leads 104 are connected to a power supply (not shown). Heating element 100 is configured as a cylindrical cartridge heater in an embodiment in accordance with the invention. Heating element 100 can be configured or shaped differently in other embodiments in accordance with the invention.

Figure 2:
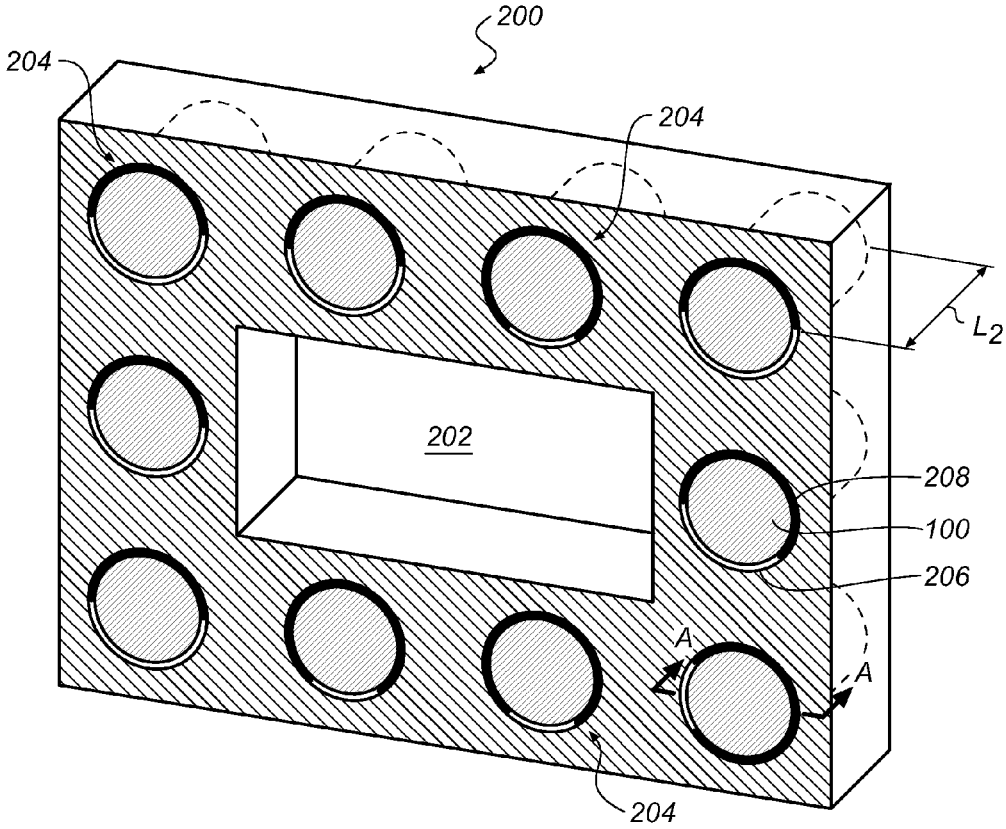
FIG. 2 is a simplified illustration of a tooling device in an embodiment in accordance with the invention.

Referring now to FIG. 2, there is shown a simplified illustration of a tooling device in an embodiment in accordance with the invention. Tooling device 200 includes a heated section 202 surrounded by heating structures 204. Each heating structure includes heating element 100 (FIG. 1). Heated section 202 is heated when heating elements 100 are activated. Tooling device is implemented as a vapor deposition machine that operates in a vacuum in an embodiment in accordance with the invention. Tooling device 200 can be different types of devices, equipment, or components in other embodiments in accordance with the invention.

Heating structures 204 also include openings 206 and heat transfer elements 208. Openings 206 are holes having a length $L_2$ that are bored into tooling device 200 in an embodiment in accordance with the invention. Heating elements 100 and heat transfer elements 208 are inserted into and surrounded by openings 206 with heat transfer elements 208 disposed between the interior surfaces of openings 206 and the exterior surfaces of heating elements 100.

Figure 3:
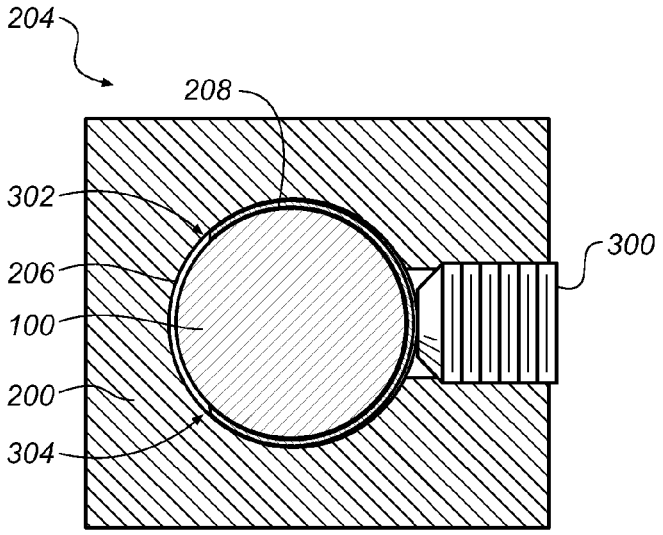
FIG. 3 is a cross-sectional view of heating structure 204 along line A-A shown in FIG. 2 in an embodiment in accordance with the invention.

FIG. 3 is a cross-sectional view of heating structure 204 along line A-A shown in FIG. 2 in an embodiment in accordance with the invention. As described with reference to FIG. 2, heating element 100 and heat transfer element 208 are inserted into opening 206, with heat transfer element 208 disposed between the interior surface of opening 206 and the exterior surface of heating element 100. Heat transfer element 208 is configured as a conductive shim, such as a thin piece of metal, having high thermal conductivity in an embodiment in accordance with the invention. The thermal gradient across the entire length and width of heat transfer element 208 is minimized when the thermal resistance of heat transfer element 208 through its thickness is low.

The material used to form heat transfer element 208 is sufficiently malleable at an operating temperature to conform to small irregularities in the surface of heating element 100 and the interior surface of opening 206 while maintaining adequate contact force to effectively transmit heat from heating element 100 to the interior surface of opening 206 in an embodiment in accordance with the invention. Additionally, heat transfer element 208 can have a high coefficient of thermal expansion so as to increase the normal force between heating element 100 and heat transfer element 208 and between the interior surface of opening 206 and heat transfer element 208 as the temperature of the heat transfer element 208 increases. Heat transfer element 208 has a coefficient of thermal conductivity of at least about 100 W/m° K. in an embodiment in accordance with the invention. By way of example only, heat transfer element 208 can be made from copper, aluminum, nickel, or an alloy thereof.

A clamping mechanism 300 clamps heating element 100 to heat transfer element 208, which in turn pinches heat transfer element 208 between the exterior surface of heating element 100 and the interior surface of opening 206. Heat transfer element 208 has the same length as heating element 100 and acts as a conformable interface between heating element 100 and the interior surface of opening 206 in an embodiment in accordance with the invention.

Heat transfer element 208 partially surrounds heating element 100 and has the form of an open arc so that contact is made between heating element 100 and the interior surface of opening 206 along at least two contact regions 302, 304. Contact regions 302, 304 each form a line of contact along the length of heating element 100. Heat transfer element 208 is configured to partially surround at least fifty percent but less than one hundred percent of heating element 100 when heating element 100 is clamped against heat transfer element 208. In this manner, heating element 100 is able to transfer heat to the interior surface of opening 206 along the at least two contact regions 302, 304.

Clamping mechanism 300 is implemented as a series of set screws positioned along the length of opening 206 in an embodiment in accordance with the invention. Other embodiments in accordance with the invention can use a different type of clamping mechanism to clamp heating element 100 against heat transfer element 208. For example, the clamping mechanism can include a wedge-shaped element in other embodiments in accordance with the invention.

When clamping mechanism 300 is made from a material having a high thermal conductivity, clamping mechanism 300 can be used to transfer heat in addition to heat transfer element 208. By way of example only, clamping mechanism 300 can be made from copper, aluminum, nickel, or an alloy thereof.

Figure 4:
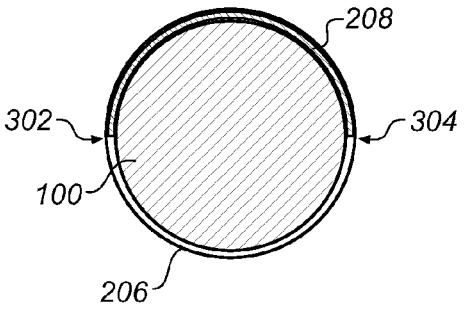
FIG. 4 is a cross-sectional view of a first exemplary heating structure in an embodiment in accordance with the invention.
Figure 5:
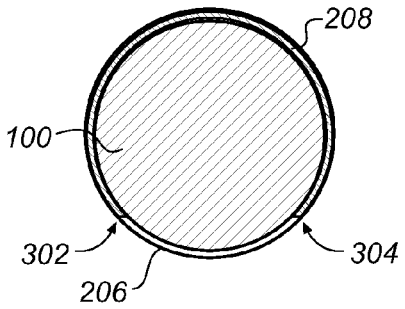
FIG. 5 is a cross-sectional view of a second exemplary heating structure in an embodiment in accordance with the invention.

FIGS. 4 and 5 depict cross-sectional views exemplary heating structures in embodiments in accordance with the invention. Heat transfer element 208 in FIG. 4 partially surrounds just over fifty percent of heating element 100. The at least two contact regions 302, 304 are directly opposite each other along a diameter of opening 206. In the FIG. 5 embodiment, heat transfer element 208 partially surrounds approximately seventy percent of heating element 100. The at least two contact regions 302, 304 are separated by approximately eighty angular degrees along the circumference of opening 206. Other embodiments in accordance with the invention can create a larger distance or smaller distance between the at least two contact regions 302, 304. The at least two contact regions 302, 304, however, should not touch and form a single line of contact between heating element 100 and heat transfer element 206. A single line of contact or two closely spaced lines of contact would not protect the cartridge heater from premature failure due to overheating when operated in vacuum.

Embodiments of the present invention provide a heating structure that can be used in high vacuum applications and provide a compact means for thermally coupling heating elements to tooling devices in a manner that prevents large temperature differences between the heating element and the tooling device. Embodiments of the present invention also allow for easy removal of the heating element at the end of its lifetime. And finally, embodiments of the present invention allow existing tooling devices, originally configured with slightly oversize cylindrical openings or bores, to be modified to operate in vacuum or simply to operate with an improved heater lifetime.

PARTS LIST

100 heating element
102 heating section
104 lead
200 tooling device
202 heated section
204 heating structure
206 opening

208 heat transfer element
300 clamping mechanism
302 contact region
304 contact region

The invention claimed is:

1. A heating structure, comprising:

a heating element surrounded by an opening; and a heat transfer element disposed between an exterior surface of the heating element and an interior surface of the opening, wherein the heat transfer element partially surrounds the heating element and is configured to create at least two elongated and spatially separate contact regions along a length of the heating element between the heating element and the interior surface of the opening.

2. The heating structure of claim 1, further comprising a tooling device that includes the opening.

3. The heating structure of claim 1, further comprising a clamping mechanism for clamping the heating element against the heat transfer element.

4. The heating structure of claim 1, wherein the heat transfer element is configured to partially surround at least fifty percent but less than one hundred percent of the heating element when the heating element is clamped against the heat transfer element.

5. The heating structure of claim 1, wherein the heating element comprises a cartridge heater.

6. The heating structure of claim 1, wherein the heat transfer element comprises a material having a coefficient of thermal conductivity of at least 100 Watt per meter Kelvin (W/mK).

7. A heating structure, comprising:

a tooling device comprising at least one opening formed therein;

a heating element surrounded by each opening;

a heat transfer element disposed between an exterior surface of each heating element and an interior surface of a respective opening; and a clamping mechanism for clamping each heating element against the heat transfer element, wherein each heat transfer element partially surrounds a respective heating element and is configured to create at least two elongated and spatially separate contact regions along a length of the heating element between the heating element and the interior surface of the opening when the heating element is clamped against the heat transfer element.

8. The heating structure of claim 7, wherein the heat transfer element is configured to partially surround at least fifty percent but less than one hundred percent of the heating element when the heating element is clamped against the heat transfer element.

9. The heating structure of claim 7, wherein the heating element comprises a cylindrical cartridge heater.

10. The heating structure of claim 7, wherein the heated member comprises a vapor deposition system.

11. The heating structure of claim 7, wherein the heat transfer element comprises a material having a coefficient of thermal conductivity of at least 100 Watt per meter Kelvin (W/mK).

* * * * *